United States Patent [19]

Yamaki

[11] Patent Number: 4,936,444

[45] Date of Patent: Jun. 26, 1990

[54] COMPARTMENTALIZED KEY CHAIN

[76] Inventor: Akihiro Yamaki, 723 B Old Bethpage Rd., Old Bethpage, N.Y. 11804

[21] Appl. No.: 349,323

[22] Filed: May 8, 1989

[51] Int. Cl.[5] ..... B65D 85/672

[52] U.S. Cl. ..... 206/38; 206/37.4

[58] Field of Search ..... 206/38.1, 38, 37.1, 206/37.4

[56] References Cited

U.S. PATENT DOCUMENTS

| | | | |
|---|---|---|---|
| 2,103,272 | 2/1935 | Branch | 206/38 |
| 2,371,308 | 3/1945 | Mosch | 206/38 |
| 4,674,628 | 6/1987 | Prinsloo et al. | 206/38 |
| 4,765,459 | 8/1988 | Edwards | 206/38.1 |

*Primary Examiner*—Paul T. Sewell

*Assistant Examiner*—Jacob K. Ackun, Jr.

*Attorney, Agent, or Firm*—William V. Pesce

[57] ABSTRACT

A key chain carrying a plurality of individually attachable cylindrical compartments with each compartment carrying items therein necessary to the user. In particular a compartment includes a visual data scroll which can be extracted therefrom by the user for information purposes, and thereafter retracted by spring actuated means similar to a window shade. Another compartment includes a buzzer alarm system comprised of a sound unit, a battery and switch electrically connected to actuate the alarm. Still another compartment includes a flash light system composed of a light bulb a battery and switch all electrically connected to energize the light.

4 Claims, 1 Drawing Sheet

COMPARTMENTALIZED KEY CHAIN

This invention relates to a special type of key-chain and in particular to a key chain compartmentalized for receiving personalized items readily accessible under certain particular conditions.

BACKGROUND

Generally key-chains are convenient means for keeping together in a single place keys which are important to the user. The user has at his or her convenience all the necessary keys they require at anyone time. However, since key-chains only carry keys, other important items must be carried elsewhere if at all.

In the use of a car, keys are always part of the items carried by the user, and generally reside where the ignition slot appears. Here one finds just the keys to the ignition and trunk, and maybe some other keys that the user needs. That is the extent of the users carrying needs. However, in the case of an accident sometimes it becomes difficult to get personal information about the driver of the car or the owner. Further, the user in such cases may have need for getting attention such as a flashlight or an alarm system.

It is therefore a principle object of the invention to provide a key-chain compartmentalized for receiving paraphernalia accessable to the user under extenuating circumstances.

Another object of the invention is to provided a key-chain disposed to providing personalized information, a flashlight, alarm, and medicants in a convenient manner.

A still further object of the invention is to provide a key chain assembly having personallitems arranged for the user for use in an emergency situation.

Other objects and advantages of the invention will become more apparent from a reading of the application and a study of the accompanying drawings.

Figure 1:
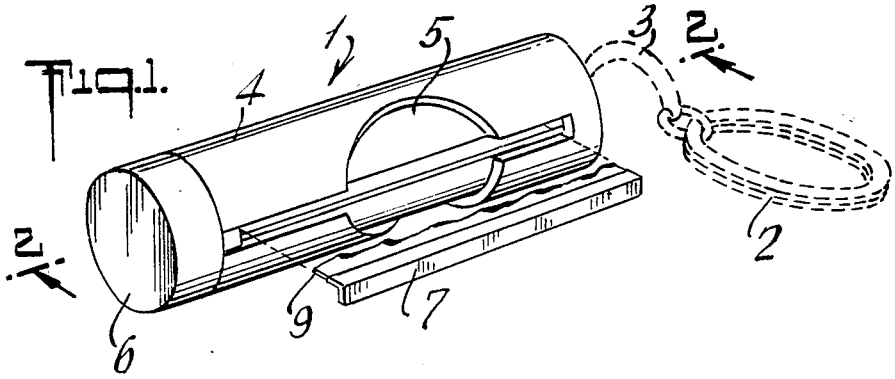
FIGS. 1 & 2 show in perspective a key-chain and a container forming a part thereof for housing an insert manually operable for observing data according to the invention herein.
Figure 2:
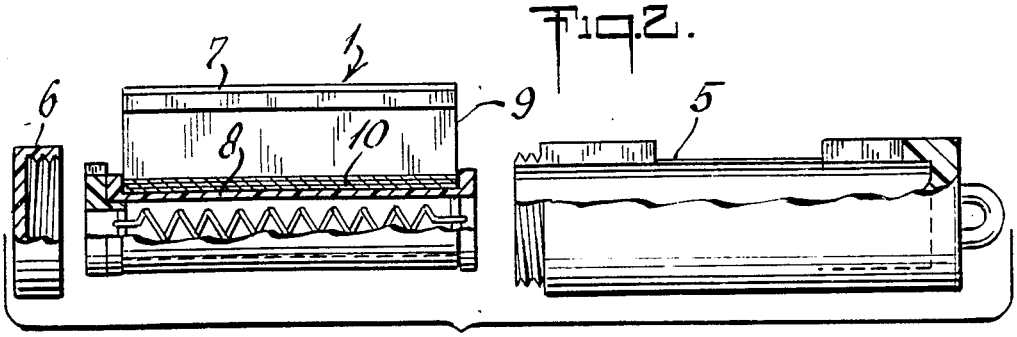

Now referring to the drawings herein there is in FIGS. 1 & 2 a key-chain 1 having a key ring 2 and a chain 3 attached thereto, which in turn connects to a cylindrical container 4 slotted 5 along the longitudinal surface thereof. The container 4 is capped at the end thereof by a cover 6 screwed to the said container. There resides within the said container 4 and insert 7 which comprises a shade like cylinder 8 containing a removable sheet of material 9 held within the container by a coil spring 10, comparable to in pull-down shades for windows and controlled by the action of the spring. The sheet of material 9 can be mechanically actuated by the user by just pulling it out from the enclosure. It behaves just like an ordinary spring-operated window shade. The sheet material 9 can be any type material upon which written information may be recorded and used by having a need for such information.

Figure 3:
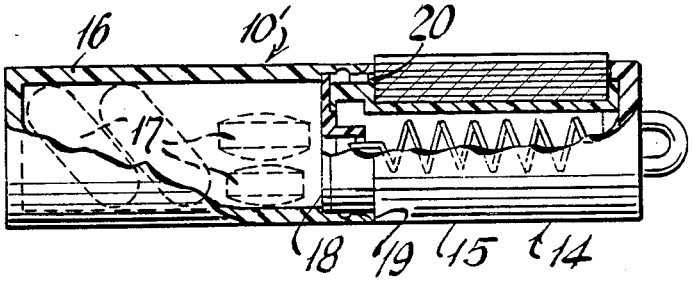
FIG. 3 shows partially sectioned a key-chain with a container attached thereto, the container comprising dual enclosures, one for housing a movable insert, and the other for containing medicants or other items of need all according to another embodiment of the invention.

FIG. 3 shows a key-chain 10' having a key ring and a chain attached thereto (not shown) which in turn connects to a cylindrical container 14 having dual enclosures 15,16 connected to each other. FIG. 3 shows an enclosure 16, having items contained therein such as medicants 17, and being attached to enclosure 15 at their respective extremities 18,19 and removed from each other by exerting force on the respective enclosures. The extremities may be connected by overlapping the enclosures so that a force fit is maintained, or by having the extremities threaded. Enclosure 14 houses an insert 20 comparable to the one described in FIGS. 1 & 2.

Figure 4:
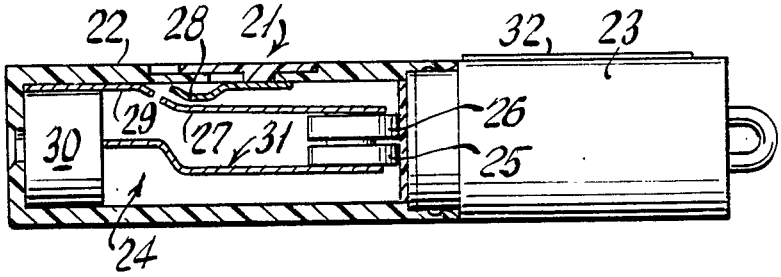
FIG. 4 shows partially sectioned a key-chain with a container forming a part thereof, and an insert for producing an alarm when actuated according to still another embodiment of the invention.

FIG. 4 shows another embodiment of the invention, and in particular comprises a key-chain similar to those previously described, but with an attached container 21 connected to the key-chain. The container 21 has dual compartments 22, and 23. The compartments 22 includes an alarm assembly 24 composed of batteries 25 connected at a terminal 26 to a malleable metal contact 27 arranged to engage a movable contact 28 when said contact is depressed. A closed electrical circuit is completed through conductor 29, alarm 30 and conductor 31 when contacts 27,28 are engaged. The completion of the circuit through the alarm unit permits the alarm to become fuctional. Compartment 23 contains an insert 32 similar to that shown in FIG. 1 and previously described.

Figure 5:
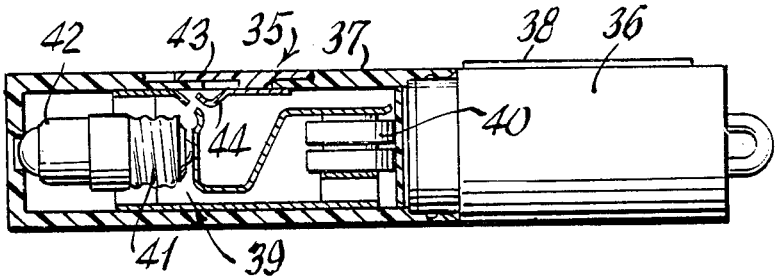
FIG. 5 shows partially sectioned a key-chain with a container forming a part thereof, and having an insert for producing a light flash when energised according to another embodiment of the invention.

FIG. 5 shows a key-chain that includes an attached container 35 having two compartments 36,37, compartment 36 containing an insert with the pull-out data sheet as in FIG. 1. Compartment 37 includes a flash-light assembly composed of batteries 40 and a lamp assembly 41. The lamp assembly shows a lamp 42 that lights up when the battery and contact 43 are connected. This is done the contact 44 is operated.

The terms and expressions which have been expressed are used in terms of description and not of limitation and there is no intention in the use of such terms and expressions of excluding any equivalents of the features shown and described or portions thereof, but is recommended that various modifications are possible within the scope of the invention claimed. For example the compartments shown are all independent of each other, as demonstrated in the various figures, and that they may all be independently substituted for each other, and new compartments added, to form a single integrated key-chain assembly.

Having described the invention what is claimed is:

1. A compartmentalized key chain comprising, (a) a key chain including a key ring attached thereto, (b) cylindrical integrated compartment means attached to said chain for storing paraphernalia germane to the user of the key chain, and (c) insert means in said compartment including visual data scroll means disposed to reside within the compartment so as to be externally extracted therefrom by the user for information purposes, and thereafter retracted by spring-actuated means.

2. A chain according to claim 1 and wherein said integrated compartment means includes at least one or more attachable compartments for storing and removing said paraphernalia.

3. A chain according to claim 1 and wherein said insert means further includes an alarm system comprised of a buzzer-like sound device, a battery driven energizing circuit connected thereto, and external manual means on said compartment for actuating said circuit.

4. A key chain according to claim 1 and wherein said insert means further includes a flash-light system composed of a lighting device connected to a battery driven circuit disposed to function by a manual switch externally positioned and operated.

* * * * *